US005836628A

United States Patent [19]

Beier

[11] Patent Number: 5,836,628

[45] Date of Patent: Nov. 17, 1998

[54] DOORJAMB REINFORCING DEVICE

[76] Inventor: Ronald A. Beier, 6641 Laurel Rd., Oklahoma City, Okla. 73162

[21] Appl. No.: 764,678

[22] Filed: Dec. 11, 1996

[51] Int. Cl.[6] ..... E05B 17/00

[52] U.S. Cl. ..... 292/346; 49/462; 49/504; 52/211; 52/514; 292/340

[58] Field of Search ..... 292/346, 340, 292/DIG. 21, DIG. 53, DIG. 64, DIG. 70; 49/460, 462, 504; 52/211, 514, 210, 207, 204.1; 70/417, 416, 418

[56] References Cited

U.S. PATENT DOCUMENTS

| | | | |
|---|---|---|---|
| 1,721,950 | 7/1929 | Gifford | 52/211 |
| 3,764,173 | 10/1973 | Griffith | 292/346 |
| 3,815,945 | 6/1974 | Lamphere | 292/340 |
| 3,888,530 | 6/1975 | Fabrici | 292/340 |
| 3,918,207 | 11/1975 | Aliotta | 52/211 X |
| 3,963,269 | 6/1976 | Rosenberg | 292/346 |
| 4,057,275 | 11/1977 | La Beaud | 292/340 |
| 4,171,837 | 10/1979 | McRoy | 292/346 |
| 4,174,862 | 11/1979 | Shane | 292/340 |
| 4,178,588 | 12/1979 | Queren | 292/346 |
| 4,383,709 | 5/1983 | Ronan | 292/346 |
| 4,416,087 | 11/1983 | Ghatak | 52/514 |
| 4,550,939 | 11/1985 | Babb, Jr. et al. | 292/340 |
| 4,684,160 | 8/1987 | Nelson | 292/340 |
| 4,717,185 | 1/1988 | Hartley | 292/346 |
| 4,770,452 | 9/1988 | Petree, Jr. | 292/340 |
| 4,854,621 | 8/1989 | Baldwin | 292/340 |
| 4,865,370 | 9/1989 | Francis | 292/340 |
| 4,887,856 | 12/1989 | Percoco et al. | 292/337 |
| 4,993,764 | 2/1991 | Barker | 292/340 |
| 5,003,727 | 4/1991 | Watten | 49/504 |
| 5,016,930 | 5/1991 | Hamilton | 292/340 |
| 5,241,790 | 9/1993 | Schimpf | 52/514 |
| 5,474,347 | 12/1995 | Vigneault et al. | 292/340 |
| 5,566,509 | 10/1996 | Long | 292/340 |
| 5,586,796 | 12/1996 | Fraser | 292/346 |

*Primary Examiner*—Darnell M. Boucher
*Attorney, Agent, or Firm*—Dunlap & Codding, P.C.

[57] ABSTRACT

A device for reinforcing a doorjamb is provided. The device includes a rigid plate member having a flange formed along one side thereof and a bolt receiving opening formed proximate an opposite side thereof. The plate member is mounted to an interior side of the doorjamb with the bolt receiving opening substantially aligned with the bolt receiving hole of the doorjamb and the flange extending over a portion of an outer edge of the doorjamb in face to face contact with the outer edge of the doorjamb.

11 Claims, 2 Drawing Sheets

DOORJAMB REINFORCING DEVICE

BACKGROUND OF THE INVENTION

1. Field of the Invention

The present invention relates generally to home security devices, and more particularly, but not by way of limitation, to an improved device for reinforcing a doorjamb.

2. Brief Description of the Related Art

Conventional striker plates provide little protection against unauthorized entry into a house or building with wooden doorjambs. The striker plate used with most door assemblies consists of a small flat plate provided with an aperture to receive a door latch or dead bolt. The striker plate is typically attached to the doorjamb with several small screws. As such, unauthorized entry into houses and buildings can often be attained merely by striking a hard blow to the door with a heavy object or by kicking the door. The force exerted on the doorjamb by the latch or dead bolt splits the doorjamb in the vicinity of the door latch assembly thereby allowing the door to open.

Numerous devices have been previously proposed for reinforcing a doorjamb, and many of these devices have achieved varying degrees of success. However, such devices are either externally mounted to the doorjamb thereby affecting the operation and aesthetic appearance of the door or they are mounted on the doorjamb such that forces exerted on the door are not effectively distributed across the doorjamb.

To this end, a need as long existed for a doorjamb reinforcing device which is internally mountable and which will effectively distribute forces exerted on a doorjamb during an attempted forced entry. It is to such an improved doorjamb reinforcing device that the present invention is directed.

BRIEF SUMMARY OF THE INVENTION

The present invention is directed to a doorjamb in combination with a device for reinforcing the doorjamb. The doorjamb is characterized as having an exterior side, an interior side, an inner edge, and an outer edge. The exterior side is provided with a stop rail against which a door engages when the door is in a closed position. The inner edge of the doorjamb is opposite the outer edge and is substantially adjacent to the door as the door is moved to the closed position. The doorjamb has a bolt receiving hole extending through the doorjamb from the exterior side to the interior side proximate the inner edge for receiving a retractable bolt of the door. The reinforcing device includes a rigid plate member having a flange formed along one side thereof and a bolt receiving opening formed proximate an opposite side thereof. The plate member is mounted to the interior side of the doorjamb with the bolt receiving opening substantially aligned with the bolt receiving hole of the doorjamb and the flange extending over a portion of the outer edge of the doorjamb in face to face contact with the outer edge of the doorjamb. The bolt receiving opening of the plate member is dimensioned such that the bolt of the door is engagable with the plate member when the bolt is extending through the bolt receiving hole of the doorjamb whereby application of a force on the door in the direction of the inner edge of the doorjamb when the bolt of the door is extended through the bolt receiving opening of the plate member causes the force to be distributed over the outer edge of the doorjamb.

The objects, features and advantages of the present invention will become apparent from the following detailed description when read in conjunction with the accompanying drawings and appended claims.

DETAILED DESCRIPTION OF THE INVENTION

Figure 1:
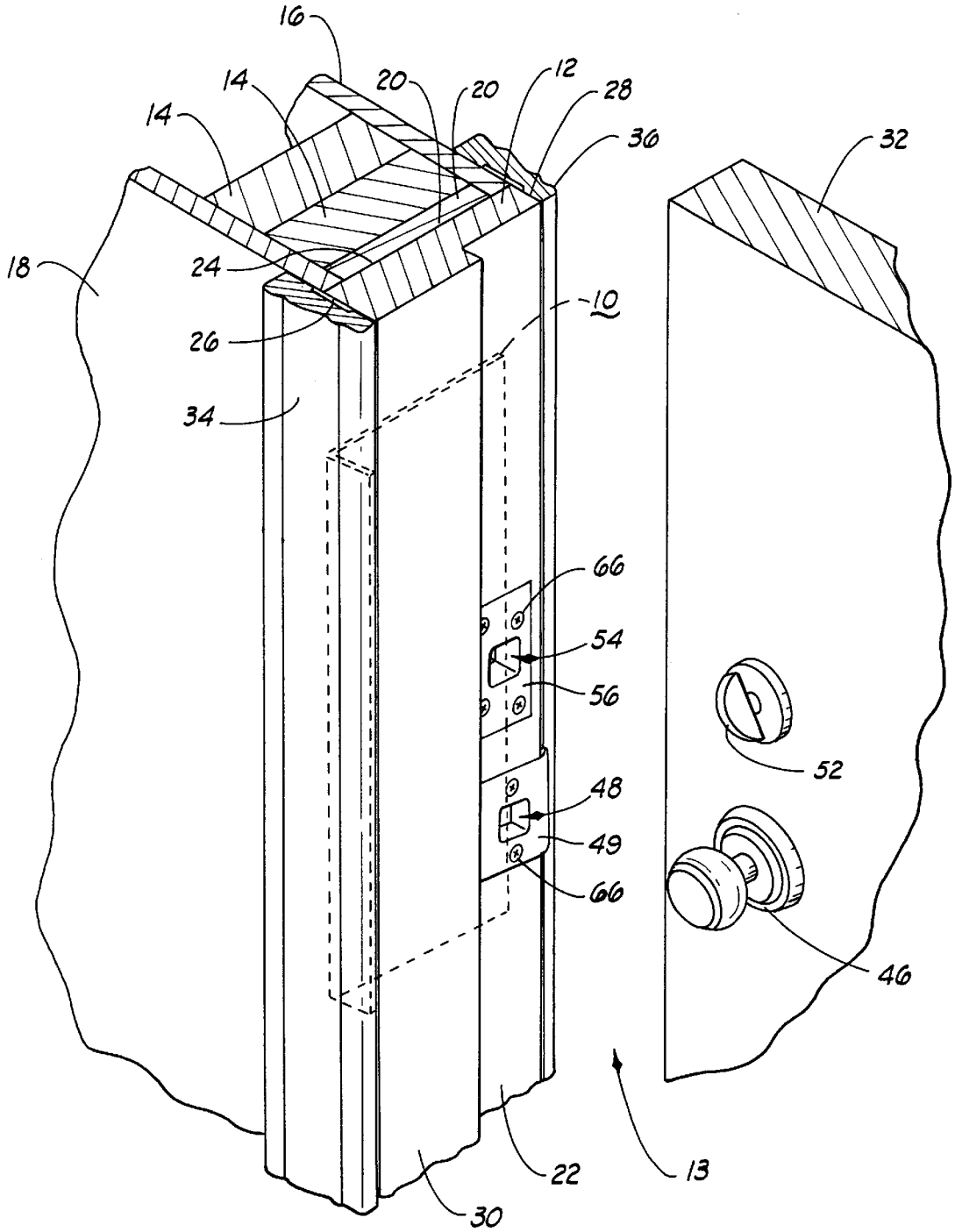
FIG. 1 is a perspective view showing a reinforcing device constructed in accordance with the present invention mounted to a doorjamb and showing a door in an open position.
Figure 2:
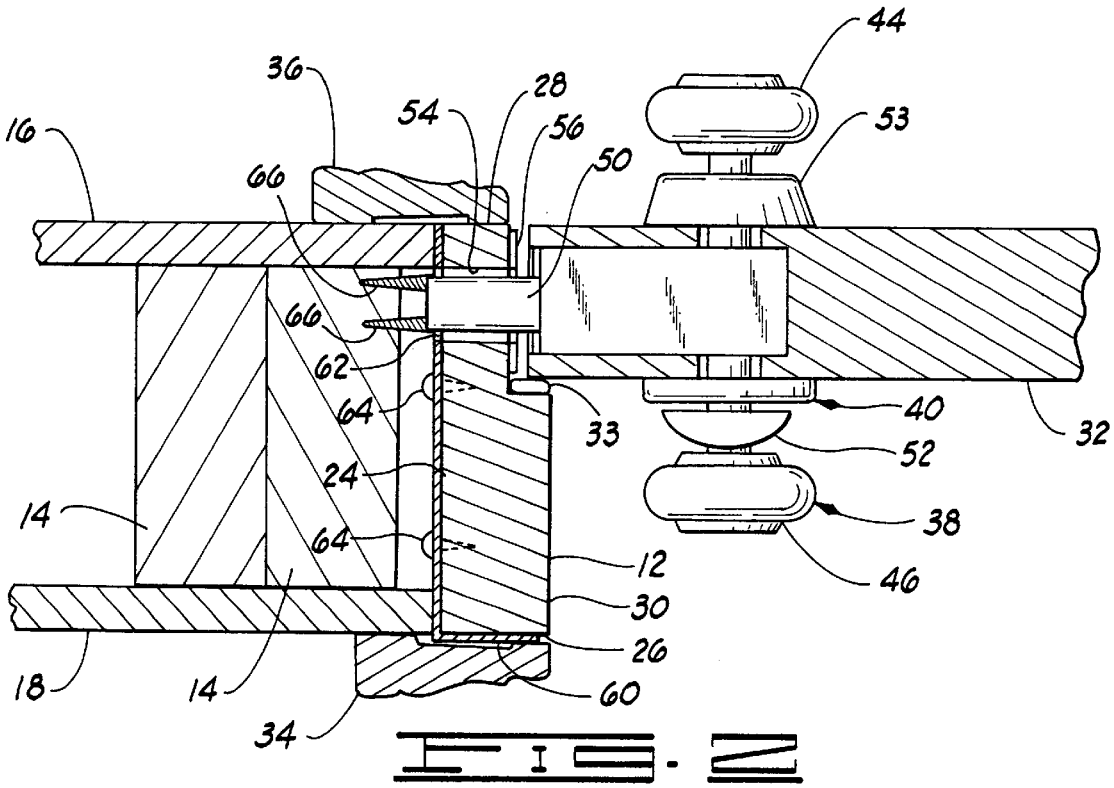
FIG. 2 is a cross sectional view showing the reinforcing device of the present invention mounted to the doorjamb with the door in a closed position and with a retractable bolt of the door extended through the reinforcing device.

Referring now to the drawings, and more particularly to FIGS. 1 and 2, a reinforcing device 10 constructed in accordance with present invention is shown mounted to a doorjamb 12. The doorjamb 12 is an upright piece forming the side of a door opening 13 and is included as part of a conventional door frame construction. Door openings are generally framed with a plurality of upright stud members 14 which are enclosed by an inner wall 16 and an outer wall 18. The doorjamb 12 is plumbed with respect to the stud members 14 with a plurality of shims 20 and secured to the stud members 14 in a suitable manner, such as with a plurality of nails (not shown).

The doorjamb 12 is characterized as having an exterior side 22, an interior side 24, an outer edge 26, and an inner edge 28. The exterior side 22 is provided with a stop rail 30 against which a hinged door 32 closes. A seal member 33 (FIG. 2) may be attached to the stop rail 30. For aesthetic purposes, door moldings 34 and 36 are attached to the outer edge 26 and the inner edge 28 of the doorjamb 12, respectively.

As best shown in FIG. 2, the door 32 comprises a lock assembly 38 and a dead bolt assembly 40. The lock assembly 38 includes a retractable bolt or latch (not shown) movable with an inner knob 44 or an outer knob 46. When the door 32 is closed against the stop rail 30, the retractable bolt (not shown) extends into a cavity or hole 48 (FIG. 1) formed in the exterior side 22 of the doorjamb 12 proximate to the inner edge 28 to interlock the door 32 with the doorjamb 12. The lock assembly 38 further includes a striker plate 49 adapted to receive the latch of the lock assembly 38.

The dead bolt assembly 40 includes a retractable bolt 50 movable with a knob 52 or a key (not shown) insertable into a housing 53. When the door 32 is closed against the stop rail 30, the retractable bolt 50 of the dead bolt assembly 40 is extendable through a bolt receiving hole 54 extending through the doorjamb 12 from the exterior side 22 to the interior side 24. The dead bolt assembly 40 further includes a striker plate 56 adapted to receive the bolt 50 of the deadbolt assembly 40.

Door frame construction as briefly discussed above, as well as the components comprising such construction, is well know in the art. Thus, no further description of the various designs of door frame construction or the components of doors and door frames is believed necessary in order to enable one skilled in the art to understand the reinforcing device 10 of the present invention and the relationship of the reinforcing device 10 to a conventional doorjamb.

Figure 3:
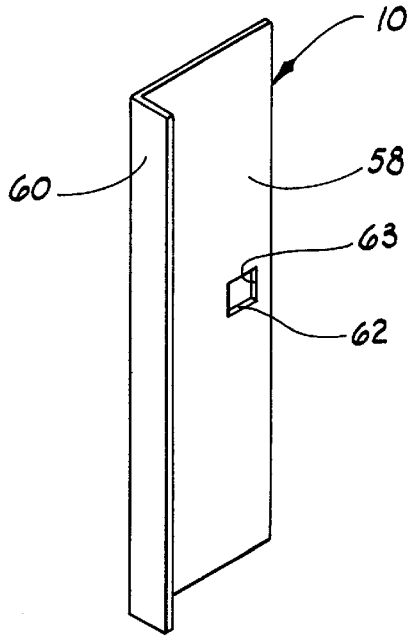
FIG. 3 is a perspective view of the reinforcing device of the present invention.

Referring now to FIGS. 1–3, the reinforcing device 10 comprises a rigid plate member 58 constructed of a rigid sheet material, preferably a metallic material of at least 18 gauge. The plate member 58 is configured to substantially conform to the interior side 24 and the outer edge 26 of the doorjamb 12 such that the plate member 58 is in substantial contact with the doorjamb 12 when the reinforcing device 10 is mounted to the doorjamb 12. More specifically, the plate member 58 includes a laterally extending flange 60 formed along one side of the plate member 58 and a bolt receiving opening 62 formed proximate an opposite side thereof. The flange 60 extends from the plate member 58 so that the flange 60 is disposable in face to face contact with the outer edge 26 of the doorjamb 12 when the reinforcing device 10 is mounted to the interior side 24 of the doorjamb 12 with the bolt receiving opening 62 aligned with the bolt receiving hole 54 of the doorjamb 12. It will be appreciated that the flange 60 will act to distribute a force exerted on the door 32 in the direction of the inner edge 28 of the doorjamb 12 to the outer edge 26 of the doorjamb 12 and thereby eliminate the stress on the doorjamb 12 in the area adjacent to the bolt receiving hole 54 and thereby prevent the doorjamb 12 from splitting in the vicinity of the bolt receiving hole 54.

The bolt receiving opening 62 of the plate member 58 is dimensioned to slidingly receive the bolt 50 of the dead bolt assembly 40. Further, the bolt receiving opening 62 is formed in the plate member 58 so that the bolt 50 of the dead bolt assembly 40 is engagable with the plate member 58 when the bolt 50 is extended through the bolt receiving hole 54 of the doorjamb 12 and into the bolt receiving opening 62. More specifically, the bolt receiving opening 62 is characterized as having an outer side 63, and the bolt receiving opening 62 is formed in the plate member 58 so that the outer side 63 of the bolt receiving opening 62 is aligned with or extends inward from the corresponding side of the bolt receiving hole 54 of the doorjamb 12 to ensure that the bolt 50 of the dead bolt assembly 40 will engage the plate member 58. By engaging the plate member 58, a force exerted on the door 32 in the direction of the inner edge 28 of the doorjamb 12 is transmitted through the plate member 58 and thus to the outer edge 26 of the doorjamb 12 instead of to the area of the doorjamb 12 adjacent the dead bolt receiving hole 54 which is substantially weaker than the outer edge 26.

To install the reinforcing device 10 on a new door or a replacement door, any nails, screws or other objects that might interfere with the reinforcing device 10 are removed from the interior side 24 of the doorjamb 12. Next, the reinforcing device 10 is mounted to the interior side of the doorjamb 12 with the bolt receiving opening 62 substantially aligned with the bolt receiving hole 54 and the flange 60 in face to face contact with the outer edge 26 of the doorjamb 12. The reinforcing device 10 is mounted to the doorjamb 12 with a plurality of self-tapping sheet metal screws 64 (FIG. 2) or other suitable fastening member.

The door along with the doorjamb is then installed in the door opening. With the door installed, shims are placed between the reinforcing device 10 and the stud members 14 above and below the bolt receiving holes 48 and 54 to support the reinforcing device 10. Next, pilot holes are drilled through the striker plates 49 and 56, the doorjamb 12, and the reinforcing device 10. Finally, the striker plates 49 and 56 are mounted to the exterior side 22 of the doorjamb 12 with a plurality of screws 66 having a length of at least 3 ½ inches whereby the screws 66 extend through the striker plates 49 and 56, the doorjamb 12, the reinforcing device 10 and into the stud member 14. In this manner, each of the striker plates 49 and 56 is tied to the reinforcing device 10.

To install the reinforcing device 10 on an existing doorjamb 12, the door molding 34 is removed from the doorjamb 12, and any nails, screws or other objects that might interfere with the placement of the reinforcing device 10 are removed from the interior side 24 of the doorjamb 12. Also, the screws fastening the striker plates 49 and 56 to the doorjamb 12 are removed. Next, the reinforcing device 10 is slid between the interior side 24 of the doorjamb 12 and the stud members 14 so that the bolt receiving opening 62 is substantially aligned with the bolt receiving hole 54 and the flange 60 is in face to face contact with the outer edge 26 of the doorjamb 12. Shims are next placed between the reinforcing device 10 and the stud members 14 above and below the bolt receiving holes 48 and 54 to support the reinforcing device 10. Next, pilot holes are drilled through the striker plates 49 and 56, the doorjamb 12, and the reinforcing device 10. Finally, the striker plates 49 and 56 are mounted to the exterior side 22 of the doorjamb 12 with a plurality of screws 66 having a length of at least 3 ½ inches whereby the screws 66 extend through the striker plates 49 and 56, the doorjamb 12, the reinforcing device 10 and into the stud member 14. In this manner, each of the striker plates 49 and 56 is tied to the reinforcing device 10.

It will be appreciated that the thin configuration of the plate member 58 permits the reinforcing device 10 to be mounted to the doorjamb 12 without interfering with the door moldings 34 and 36 which can be positioned directly over the reinforcing device 10 as illustrated in FIGS. 1 and 2. The thin configuration of the plate member 58 further enables the reinforcing device 10 to be installed on the doorjamb 12 without first modifying the doorjamb 12 in any manner.

The plate member 58 can be formed to have any length sufficient to provide a solid and durable structure. A preferable length of the plate member 58, however, is in a range from about eight inches to about twenty inches. If the dead bolt assembly 40 is spaced from the lock assembly 38 so as to require the reinforcing device 10 to be greater in length than twenty inches, it is preferable to use a separate reinforcing device 10 for the lock assembly 38 and the dead bolt assembly 40.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A doorjamb in combination with a device for reinforcing the doorjamb, the doorjamb having an exterior side, an interior side, an inner edge, and an outer edge, the exterior side having a stop rail against which a door engages when the door is in a closed position, the inner edge of the doorjamb opposing the outer edge and being adjacent to the door as the door is moved to the closed position, the doorjamb having a bolt receiving hole extending through the doorjamb from the exterior side to the interior side proximate the inner edge for receiving a retractable bolt of the door, the device comprising:

a rigid plate member having a flange formed along one side thereof and a bolt receiving opening formed proximate an opposite side thereof, the plate member mounted to the interior side of the doorjamb with the bolt receiving opening substantially aligned with the bolt receiving hole of the doorjamb and the flange extending over a substantial portion of the outer edge of the doorjamb in contact with the outer edge of the doorjamb such that application of a force on the door in the direction of the inner edge of the doorjamb when the bolt of the door is extended through the bolt receiving opening of the plate member causes the force to be distributed over a substantial portion of the outer edge of the doorjamb.

2. The combination of claim 1 wherein the flange is in face to face contact with the outer edge of the doorjamb.

3. The combination of claim 1 wherein the bolt receiving opening is characterized as having an outer side which is engagable with the bolt of the door when the bolt is extending through the bolt receiving hole of the doorjamb and the bolt receiving opening of the plate member.

4. The combination of claim 1 wherein the doorjamb is provided with a striker plate adapted to receive the bolt of the door, and wherein the striker plate is connected to the exterior side of the doorjamb with a plurality of fastening members which extend through the doorjamb and into the plate member so as to tie the striker plate to the plate member.

5. The combination of claim 4 wherein the door further includes a second retractable bolt insertable into a second bolt receiving hole in the doorjamb, wherein the doorjamb is provided with a second striker plate adapted to receive the second bolt, and wherein the second striker plate is connected to the doorjamb with a plurality of fastening members extending through the doorjamb and into the plate member so as to tie the second striker plate to the plate member.

6. The combination of claim 1 wherein the plate member has a length ranging from about eight inches to about twenty inches.

7. A doorjamb in combination with a device for reinforcing the doorjamb, the doorjamb having an exterior side, an interior side, an inner edge, and an outer edge, the exterior side having a stop rail against which a door engages when the door is in a closed position, the inner edge of the doorjamb opposing the outer edge and being adjacent to the door as the door is moved to the closed position, the doorjamb having a first bolt receiving hole extending through the doorjamb from the exterior side to the interior side proximate the inner edge for receiving a first retractable bolt of the door and the doorjamb having a second retractable bolt insertable into a second bolt receiving hole formed in the exterior side of the doorjamb for receiving a second retractable bolt of the door, the doorjamb including a first striker plate adapted to receive the first bolt and a second striker plate adapted to receive the second bolt, the device comprising:

a rigid plate member having a flange formed along one side thereof and a bolt receiving opening formed proximate an opposite side thereof, the plate member mounted to the interior side of the doorjamb with the bolt receiving opening substantially aligned with the first bolt receiving hole of the doorjamb and the flange extending over a substantial portion of the outer edge of the doorjamb in face to face contact with the outer edge of the doorjamb, the first striker plate mounted to the exterior side of the doorjamb about the first bolt receiving hole with a plurality of fastening members extending through the doorjamb and into the plate member so as to tie the first striker plate to the plate member and the second striker plate mounted to the exterior side of the doorjamb about the second bolt receiving hole with a plurality of fastening members extending through the doorjamb and into the plate member so as to tie the second striker plate to the plate member, the bolt receiving opening of the plate member being dimensioned such that the first bolt of the door is engagable with the plate member when the first bolt is extending through the first bolt receiving hole of the doorjamb whereby application of a force on the door in the direction of the inner edge of the doorjamb when the first bolt of the door is extended through the first bolt receiving opening of the plate member causes the force to be distributed over a substantial portion of the outer edge of the doorjamb.

8. The combination of claim 7 wherein the plate member has a length ranging from about eight inches to about twenty inches.

9. A method of reinforcing a doorjamb having an exterior side, an interior side, an inner edge, and an outer edge, the exterior side having a stop rail against which a door engages when the door is in a closed position, the inner edge of the doorjamb opposing the outer edge and being adjacent to the door as the door is moved to the closed position, the doorjamb having a bolt receiving hole extending through the doorjamb from the exterior side to the interior side proximate the inner edge for receiving a retractable bolt of the door, the method comprising the steps of:

providing a rigid plate member having a flange formed along one side thereof and a bolt receiving opening formed proximate an opposite side thereof;

mounting the plate member to the interior side of the doorjamb with the bolt receiving opening substantially aligned with the bolt receiving hole of the doorjamb and the flange extending over a substantial portion of the outer edge of the doorjamb in face to face contact with the outer edge of the doorjamb whereby application of a force on the door in the direction of the inner edge of the doorjamb when the bolt of the door is extended through the bolt receiving opening of the plate member causes the force to be distributed over a substantial portion of the outer edge of the doorjamb.

10. The method of claim 9 wherein the doorjamb is provided with a striker plate adapted to receive the bolt of the door, and wherein the step of mounting the plate member comprises the step of:

attaching the striker plate to the exterior side of the doorjamb with a plurality of fastening members such that the fastening members extend through the doorjamb and into the plate member so as to tie the striker plate to the plate member.

11. The method of claim 10 wherein the door further includes a second retractable bolt insertable into a second bolt receiving hole in the doorjamb, wherein the doorjamb is provided with a second striker plate adapted to receive the second bolt, and wherein the step of mounting the plate member further comprises the step of:

attaching the second striker plate to the exterior side of the doorjamb with a plurality of fastening members such that the fastening members extend through the doorjamb and into the plate member so as to tie the second striker plate to the plate member.

* * * * *